United States Patent [19]

Carlson

[11] 3,958,477

[45] *May 25, 1976

[54] FLAT STOCK CUTTER

[76] Inventor: Richard L. Carlson, 3601 Lemon Tree Lane, Auburn, Wash. 98002

[ * ] Notice: The portion of the term of this patent subsequent to July 16, 1991, has been disclaimed.

[22] Filed: July 12, 1974

[21] Appl. No.: 488,231

Related U.S. Application Data

[63] Continuation-in-part of Ser. No. 256,908, May 25, 1972, Pat. No. 3,823,635.

[52] U.S. Cl. ..... 83/167; 83/455; 83/485; 83/508; 83/522; 83/582

[51] Int. Cl.[2] ..... B26D 1/20

[58] Field of Search ..... 83/455, 485, 460, 508, 83/582, 614, 522, 167

[56] References Cited

UNITED STATES PATENTS

| | | | |
|---|---|---|---|
| 804,520 | 11/1905 | Colthar | 83/485 X |
| 1,735,520 | 11/1929 | Williams | 83/485 |
| 1,967,324 | 7/1934 | Powers | 83/485 |
| 2,327,223 | 8/1943 | Silver | 83/485 X |
| 3,532,018 | 10/1970 | Szabo | 83/485 X |
| 3,543,627 | 12/1970 | Hearns | 83/455 |
| 3,662,639 | 5/1972 | Wheeler et al. | 83/508 X |
| 3,823,635 | 7/1974 | Carlson | 83/455 X |

*Primary Examiner*—Frank T. Yost
*Attorney, Agent, or Firm*—Morris A. Case

[57] ABSTRACT

A cutter assembly wherein material to be cut passes underneath a cutter bar, a track extending under the cutter bar holds a moveable carriage, a rotatable cutter wheel mounts to the carriage, with a side against the face of the cutter bar, a releasable gripper bar holds the material against the underside of the cutter bar during the cutting cycle, cords attached to the slideable carriage are used to pull the carriage along the track, and means are provided to attach the assembly to a support. A cutter as above mounted in a frame, and having an electric drive motor with controls for moving the carriage, and a cutter as above which is moved by a handle attached to the carriage are also disclosed.

20 Claims, 26 Drawing Figures

Fig. 3.
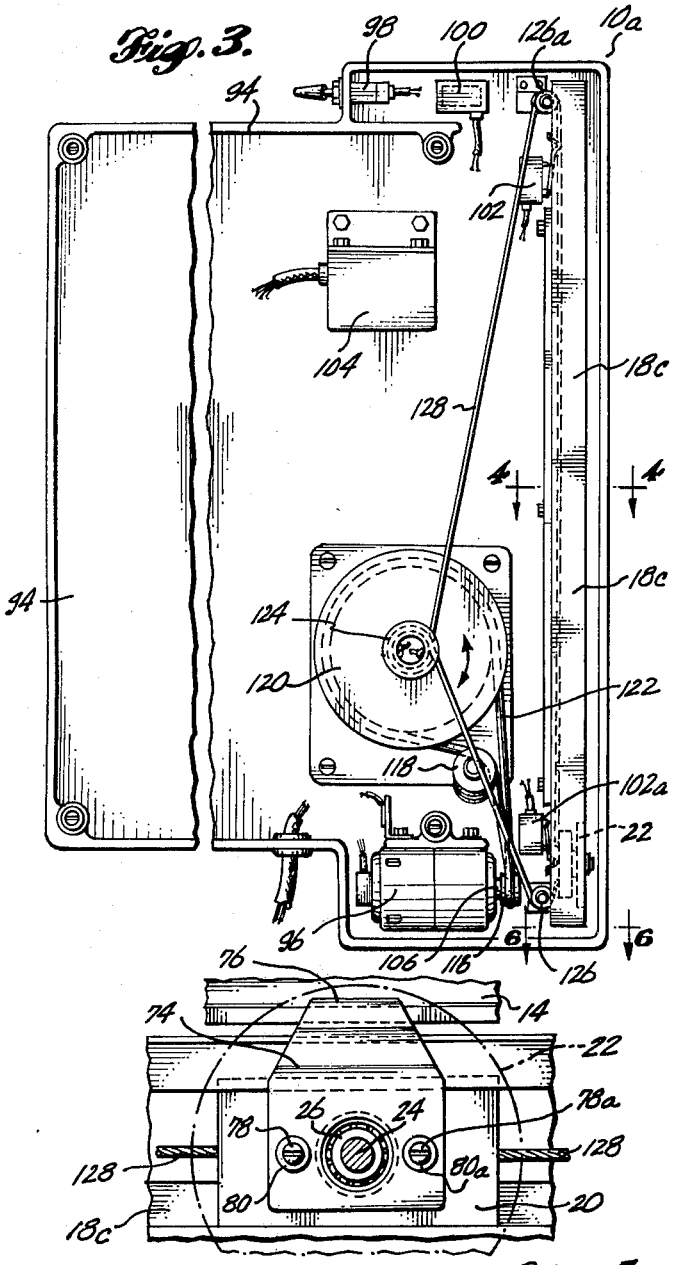
Fig. 4.
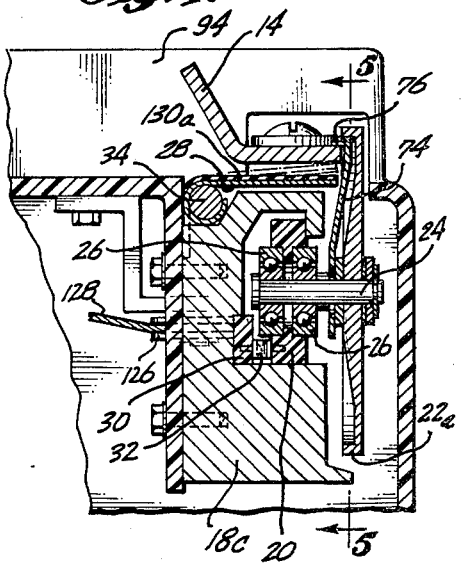
Fig. 6.
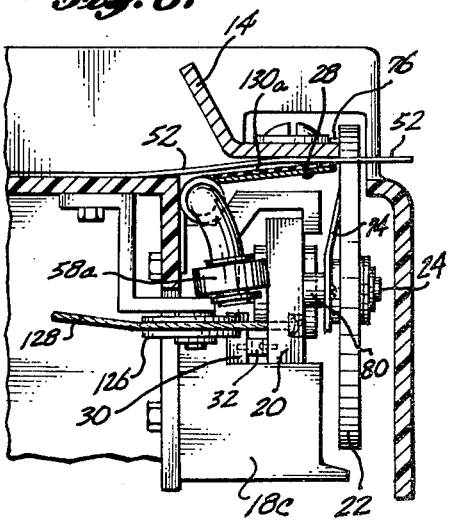
Fig. 5.
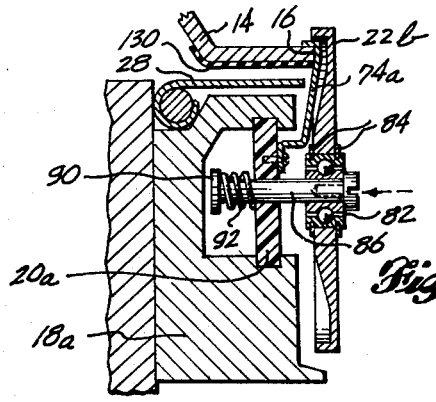
Fig. 7.
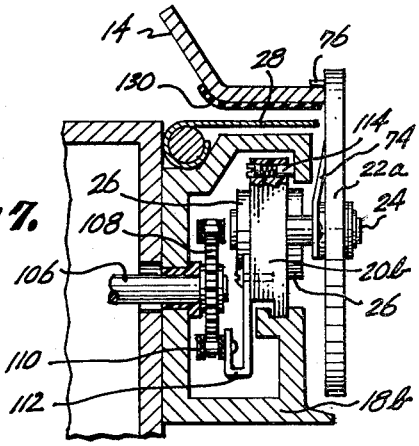
Fig. 8.

FLAT STOCK CUTTER

BACKGROUND OF THE INVENTION

This is a continuation-in-part of application Ser. No. 256,908, filed May 11, 1972, since issued as U.S. Pat. No. 3,823,635.

Cutters of flat stock or sheet material traditionally use a flat surface one edge of which has a cutter bar. The material to be cut is placed on the surface and a sharpened rolling cutter, knife or guillotine is brought along the cutter bar from above to effect the cut. These devices all do a good job, however, the material to be cut obscures the line of cut and there is always the possibility of the operator being injured. It was discouvered that one could raise the cutter bar, pass the flat stock underneath and accomplish the cut with a cutter wheel which operates against the face of the cutter bar from the bottom up. This gives two distinct advantages. The line of cut is readily observable with the material in position and it is almost impossible for the operator to get cut. The cutter wheel is sharpened alaong the side of the wheel in contact with the cutter bar, but the width of the wheel need not be bevelled so that one can place their hand on top of the cutter bar, run the wheel to cut material and the hand is pushed away by the cutter with no ill effects.

SUMMARY OF THE INVENTION

A cutter bar is located such that material to be cut passes under the bar allowing an unobstructed view of the line of cut as defined by the face of the cutter bar. A freely rotatable cutter wheel passes along the face of the cutter bar, to effect a cut, with one side of the cutter wheel held in contact with the face of the cutter bar. The cutter wheel is mounted to a carriage which in turn is moveably mounted in a track located below the cutter bar.

The carriage is pulled back and forth along the track in one embodiment by a pair of cords with one fastened to each end of the carriage. In another embodiment the unit is powered with an electric motor. In yet another embodiment the carriage is moved manually by a handle connected to the carriage.

A pivotally mounted gripper bar is resiliently urged against the unerside of the cutter bar to hold the material in place during the cutting cycle and means are provided to release the gripper bar to allow insertion or removal of material.

An object of this invention is to provide a flat stock material cutter assembly safe to operate.

Another object is to provide a cutter where the line of cut remains visible with the material placed ready to be trimmed.

Another object of this invention is to provide a hand operated cutter assembly that may be quickly mounted to a support.

Still another object of this invention is to provide an integrated cutter for flat stock or sheet material that is completely powered.

Yet another object is to provide a cutter assembly for sheet material where the material is automatically held during the cutting cycle.

DESCRIPTION OF THE DRAWINGS

FIG. 3 is a plan view from the bottom of one embodiment of the system for driving the powered cutter.

FIG. 4 is a sectional view along section 4—4 of FIG. 3.

FIG. 5 is an elevation as seen in section 5—5 of FIG. 4.

FIG. 6 is a sectional view along section 6—6 of FIG. 3.

FIG. 7 is a side elevation showing the relationship of parts of the invention when a chain drive system is being used.

FIG. 8 is a side elevation with parts in section to show a means for resiliently holding the cutter wheel against the face of the cutter bar.

DETAILED DESCRIPTION

This invention discloses a hand operated cutter assembly that may be detachably mounted to a support such as but not limited to a table or a wall, and also discloses an integrated unit with a hand operated or motor driven cutter assembly mounted ta a frame.

Figures 9, 10, 11, 12, 13, 14:
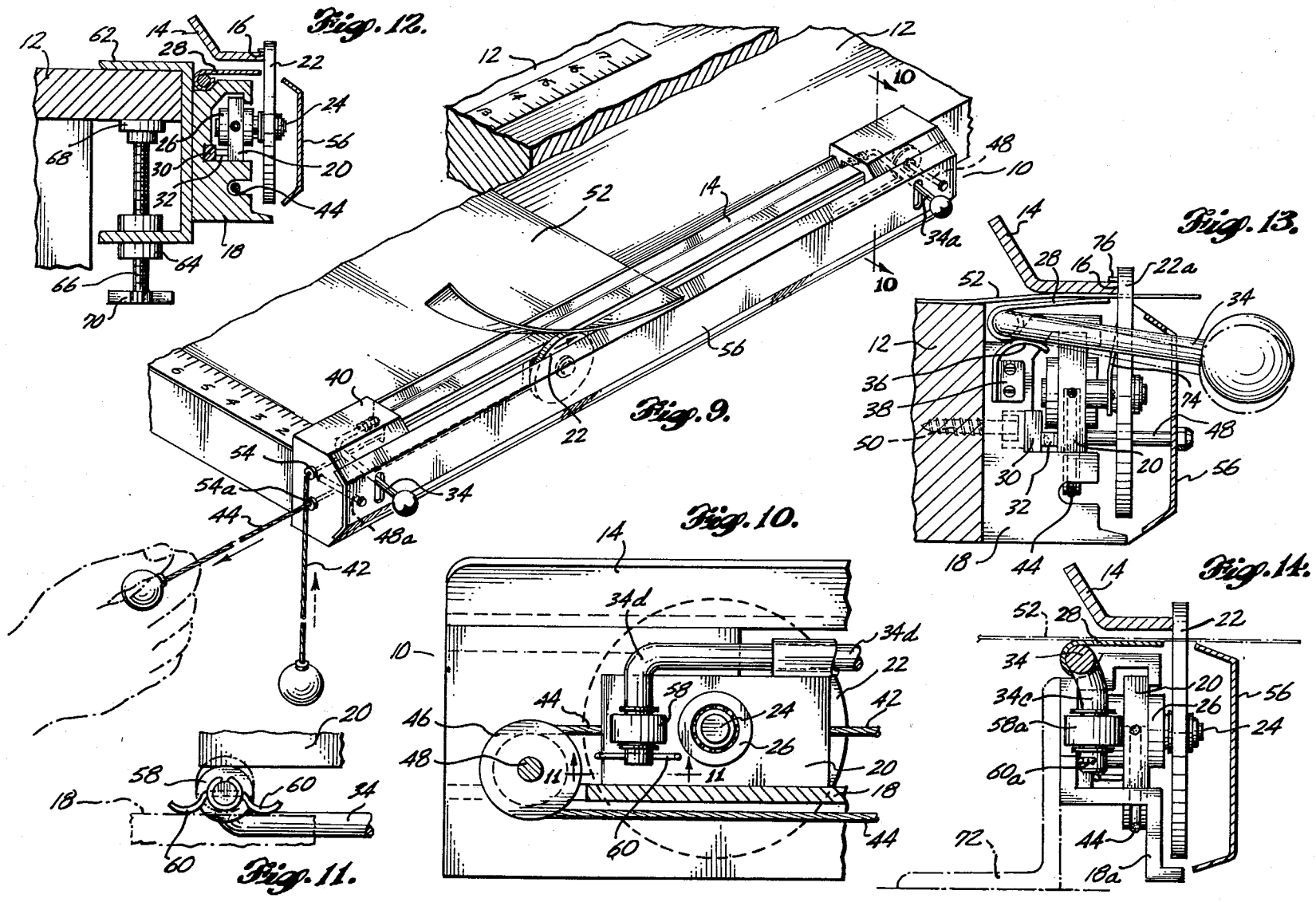
FIG. 9 is an isometric view of a cutter assembly mounted to the edge of a support and illustrating a hand powered cutter.
FIG. 10 is an elevation showing an alternate, automatic means of release for a gripper bar as seen in secton 10—10 of FIG. 9.
FIG. 11 is a sectional view taken along section 11—11 of FIG. 10.
FIG. 12 is a side elevation illustrating a quick means of clamping a cutter assembly to a horizontal support.
FIG. 13 is a side elevation illustrating a means of spring loading the gripper bar and also a method of fastening the cutter assembly to a support.
FIG. 14 is a side elevation illustrating an alternate means of fastening the cutter assembly to a support.
Figure 15:
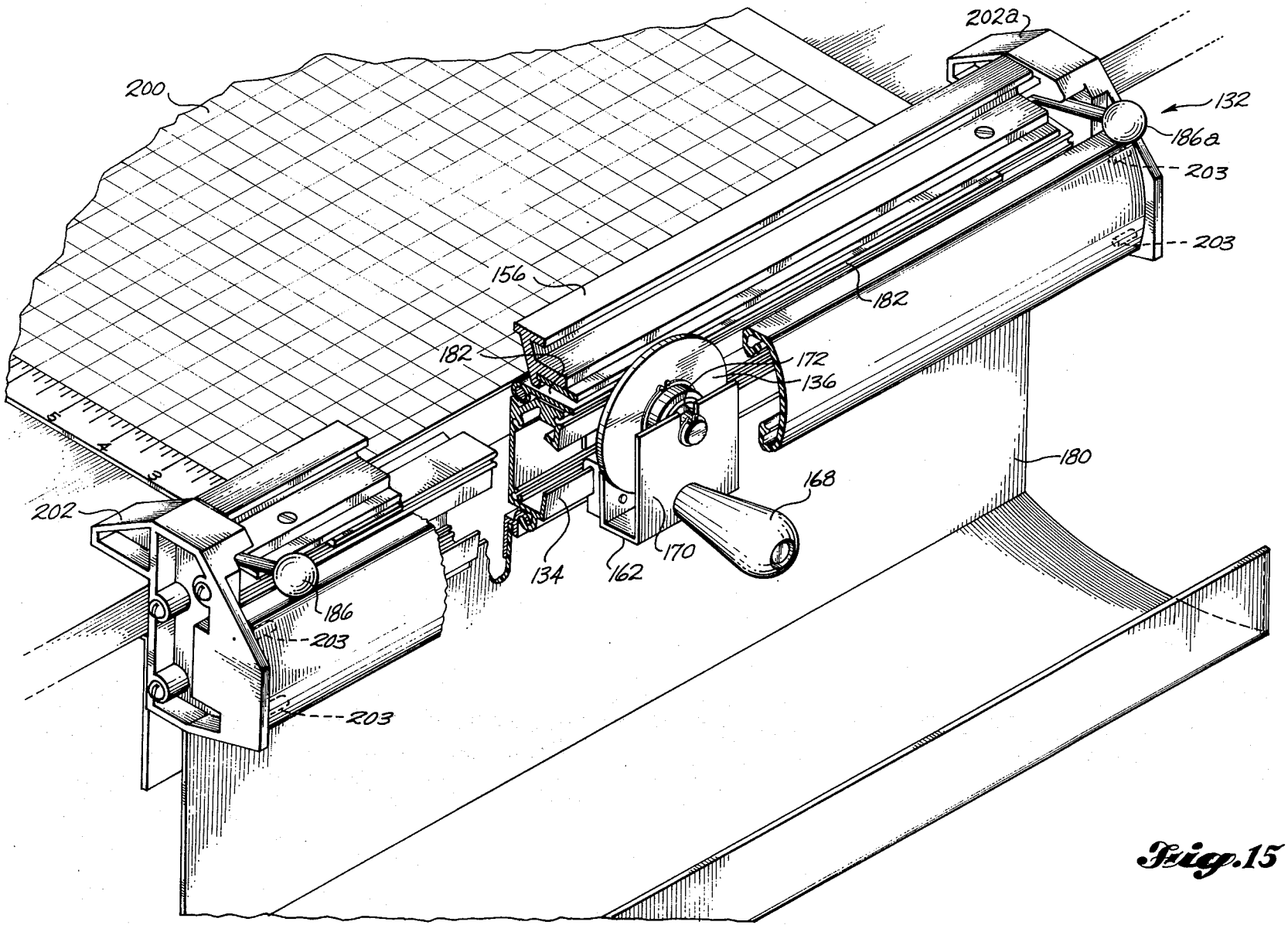
FIG. 15 shows a fragmented perspective view partially in section of a cutter assembly actuated by a handle.
Figures 16, 17:
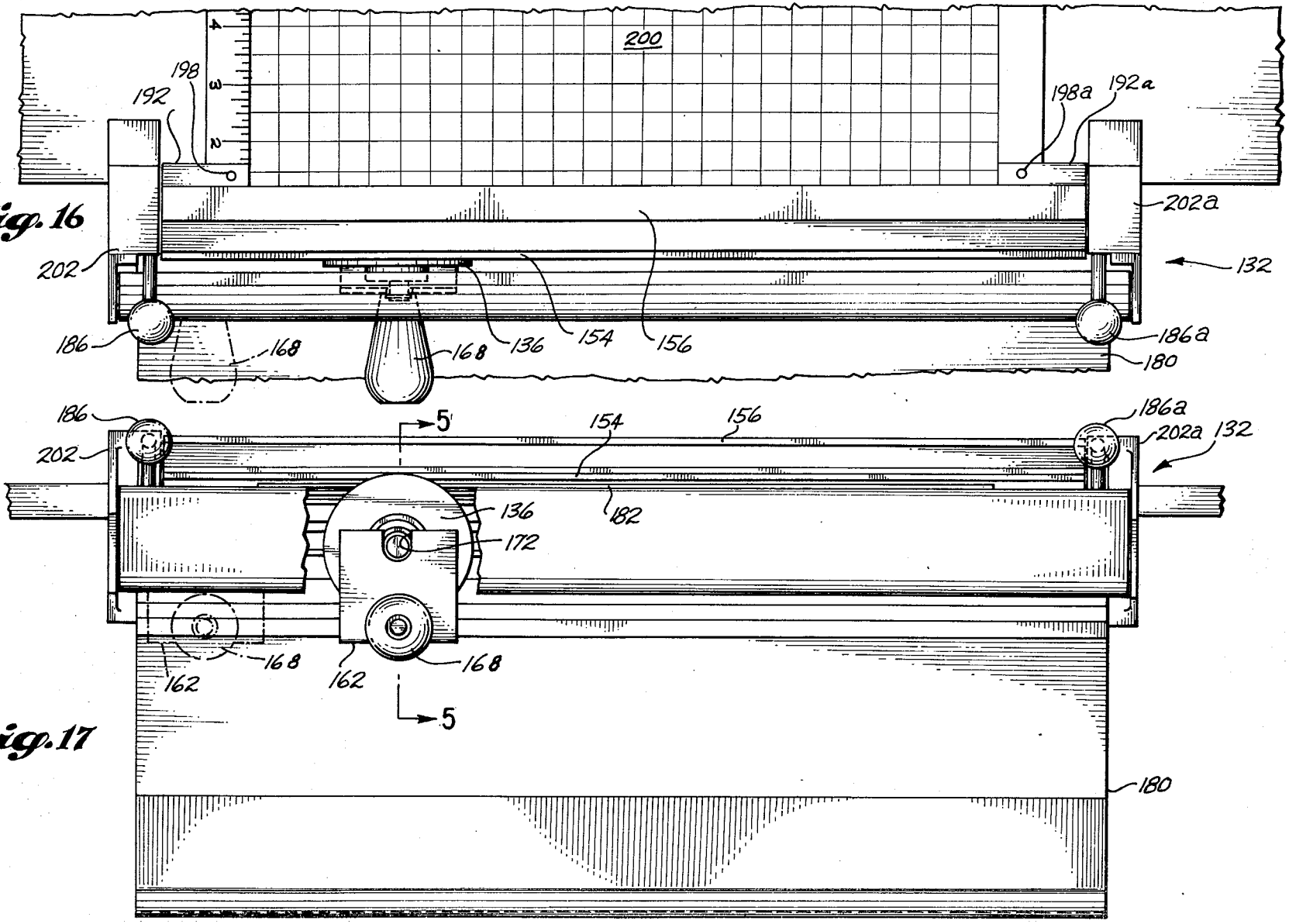
FIG. 16 shows a fragmented plan view of the cutter of FIG. 15.
FIG. 17 shows a front elevation of the cutter of FIG. 15.
Figure 18:
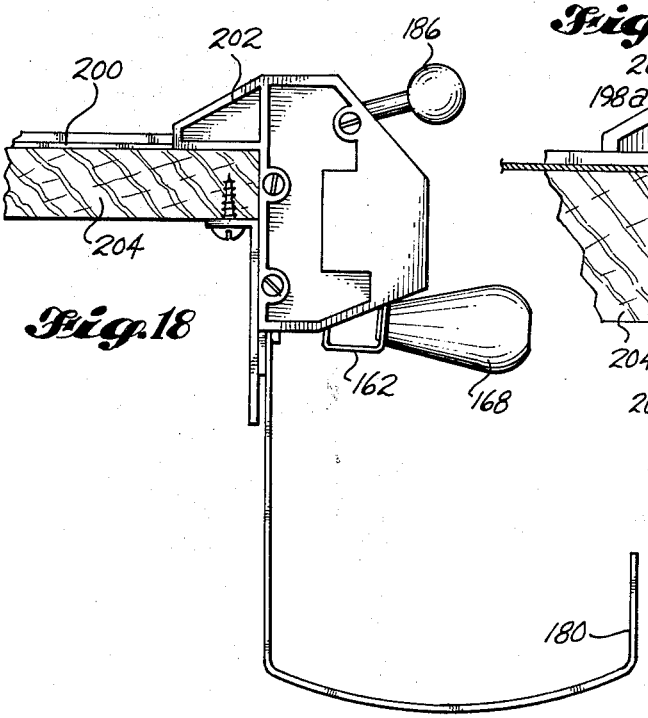
FIG. 18 shows a side elevation of the cutter of FIG. 15.
Figure 19:
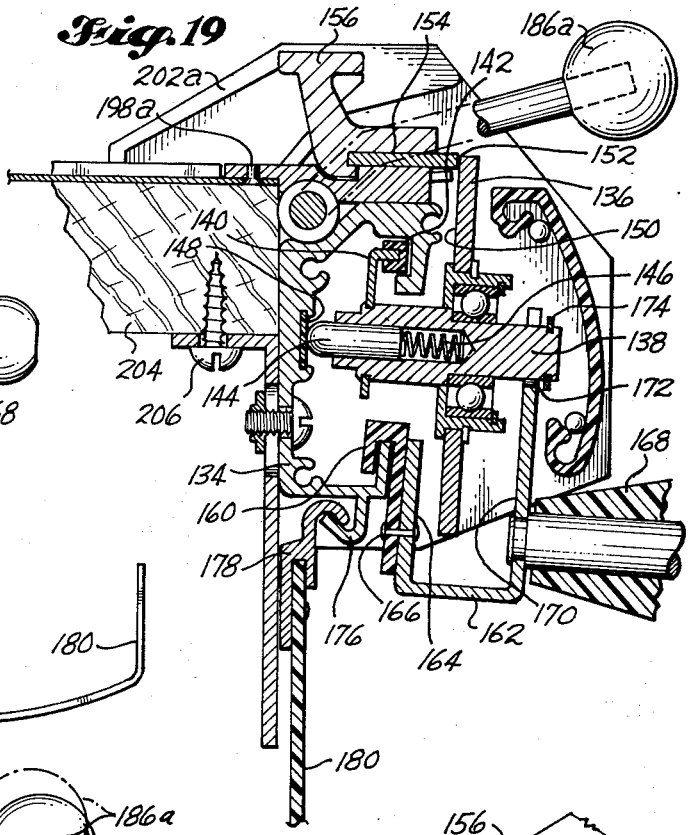
FIG. 19 is a fragmented sectional view taken along line 19—19 of FIG. 17.
Figure 20:
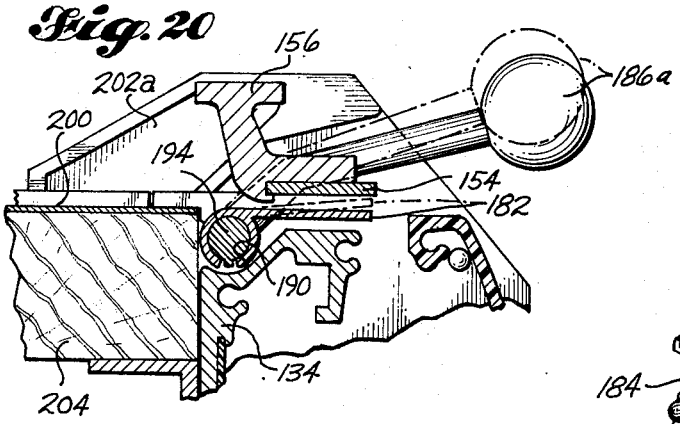
FIG. 20 is an enlarged view of part of FIG. 19 to show the positions of a gripper bar.
Figure 22:
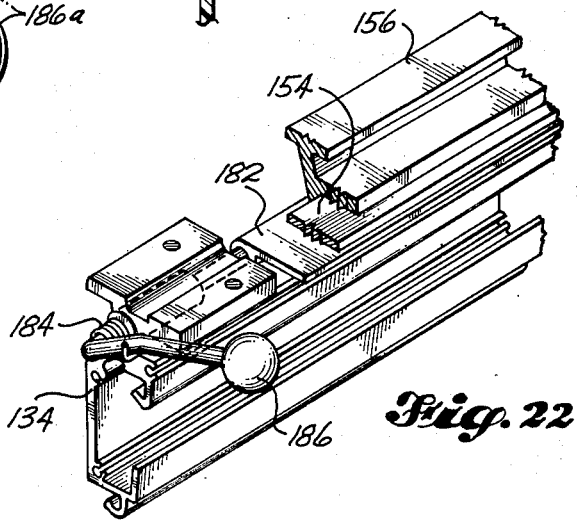
FIG. 22 shows a fragmented perspective view partially cut away of the cutter of FIG. 15.
Figure 21:
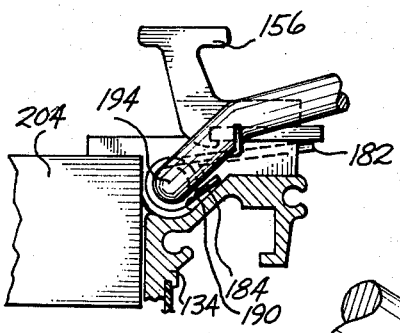
FIG. 21 shows the spring arrangement for the gripper bar of FIG. 20.
Figure 23:
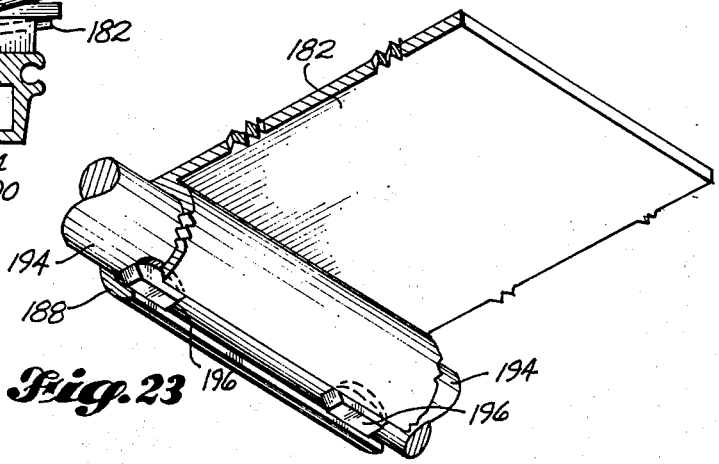
FIG. 23 shows a fragmented perspective view of the gripper bar.
Figure 24:
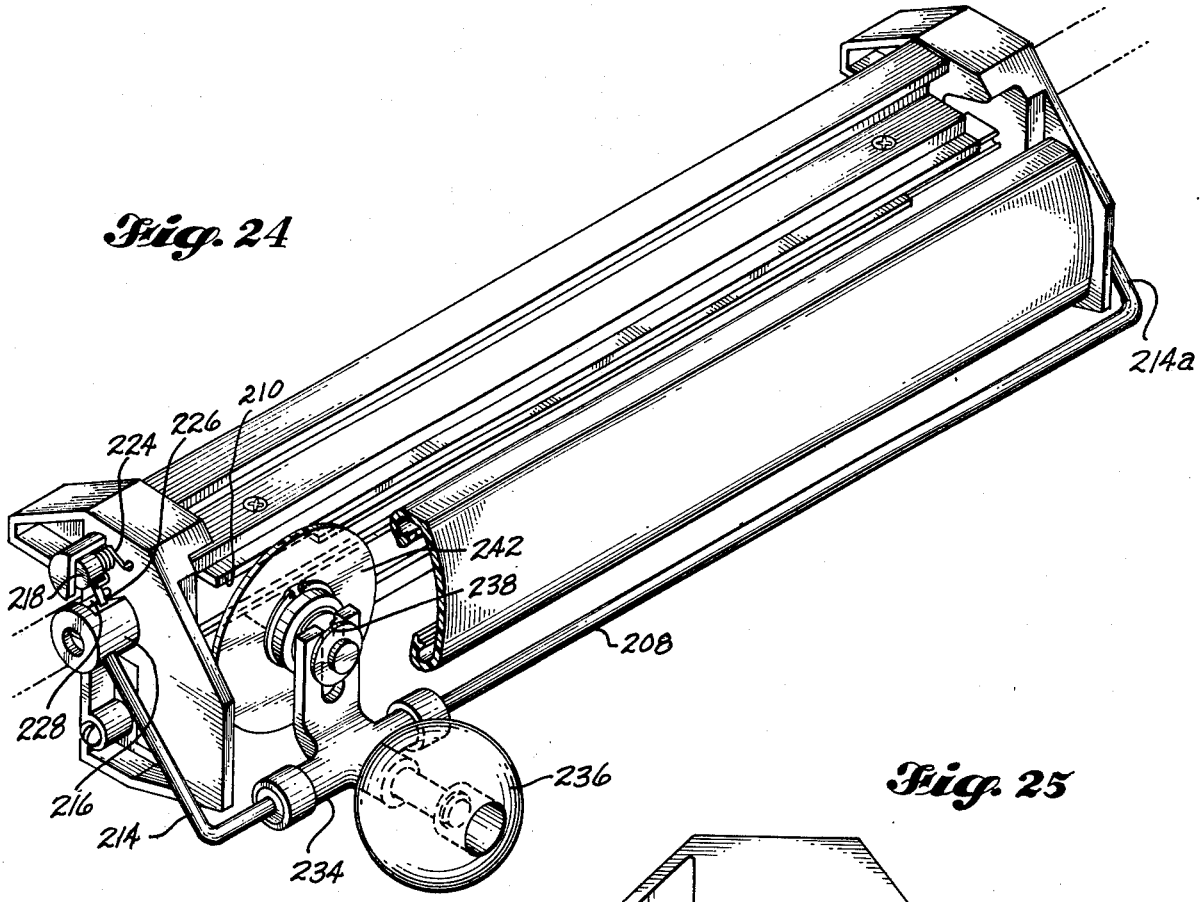
FIG. 24 shows a perspective view of yet another hand operated cutter assembly.
Figure 25:
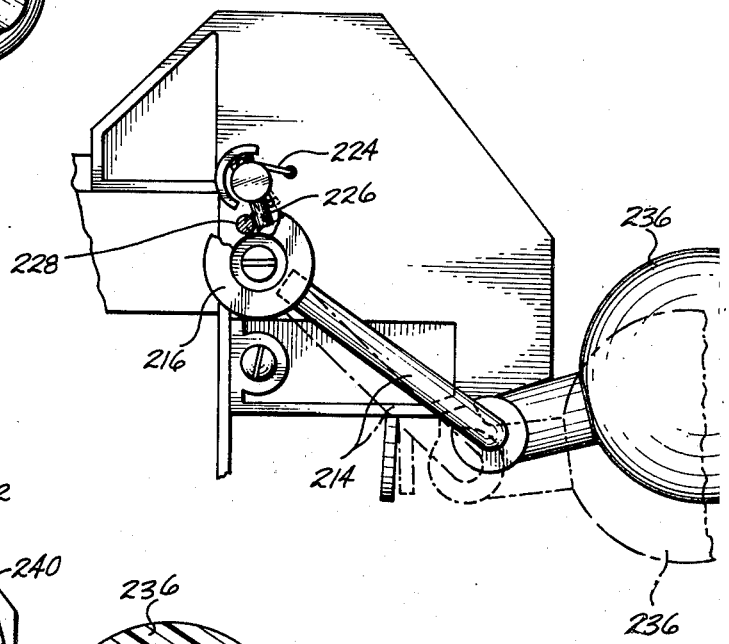
FIG. 25 shows an end elevation of the cutter of FIG. 24.
Figure 26:
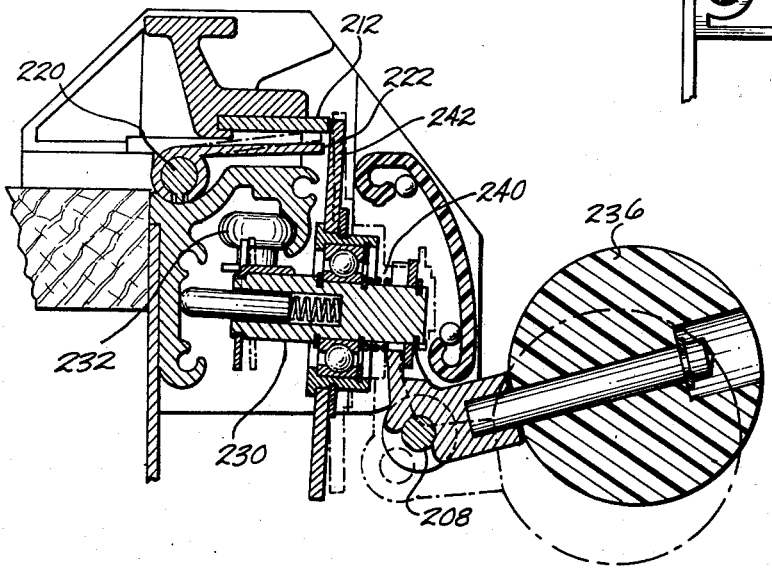
FIG. 26 shows an end elevation in section of the cutter of FIG. 24.

In FIG. 9 a hand operated cutter assembly 10, is shown mounted to a support 12. Many of the essential elements of the cutter assembly are most simply shown in FIG. 12. In FIG. 12 there is cutter bar 14, with face 16, of that bar defining the line of cut, a track 18, mounted is below the cutter bar. A carriage 20, is slideably mounted in the track and cutter wheel 22, is rotatably mounted to the carriage through pin 24, which extends through bearing 26. Pivotal mounted gripper bar 28, shown in the released position, may be rotated to contact the underside of the cutter bar. The carriage is both slideably and pivotally mounted in the track. When sliding the carriage moves parallel with the line of cut and when pivoting moves normal to the line of cut and normal to the direction of the line of the slide. A slideably mounted block 30, slides with the carriage, and spring 32, acting between the sliding block and the carriage pivots the carriage forcing one side of the cutter wheel against the face 16, of the cutter bar.

In FIG. 13 a lever arm 34, fastened to one end of the gripper bar 28, extends to the front of the cutter assembly 10, at approximately right angles from the pivot line of the gripper bar. Another lever arm, 34a, is located at the other end of the gripper bar. Leaf spring 36, fastened to the track 18, by clamp 38, pivots the gripper bar to firmly urge that bar against the underside of the cutter bar 14. Either lever arm may be pushed downward to work against the leaf spring to rotate the gripper bar to thereby move it away from the cutter bar. In place of the leaf spring one may use any resilient means such as an elastic rubber material or it may be a coil spring 40, as shown in FIG. 9.

In FIG. 10 a cord 42, is fastened to the carriage 20 at one end of the carriage and a pull on that cord will slide the carriage along the track 18. A second cord 44, is fastened to the other end of the carriage and a pull on the second cord will move the carriage in the opposite direction. Cord 44, is passed over a rotatable pulley 46, which is rotatably mounted on pin 48. This allows cord 44 to reverse direction so the same direction of pull may be applied to either cord. In FIG. 9 a pin 48*a*, is mounted near the opposite end of the track. This allows one to selectively place pulley 46, on either pin 48 or pin 48*a*, such that the direction of pull of the cords may both be from either the right hand or the left hand of the assembly 10.

In operation of one preferred embodiment the cutter assembly 10, is attached to support 12, by screw 50, as shown in FIG. 13. Cord 42, is pulled to slideably move carriage 20, to one side of the assembly. Lever arm 34 or 34*a*is depressed to move gripper bar 28, away from cutter bar 14, and a flat stock material 52, is freely moved to a position under the cutter bar in the cutter. This cutting edge or face 16, is readily observable and defines the line to be cut on the material. When the material is properly positioned the lever arm is released and the gripper bar pivots due to the spring to force and hold the material against the underside of the cutter bar. Cord 44, is pulled to move the carriage 20, with rotatably mounted cutter wheel 22, across the face of the cutter bar to shear the material as shown in FIG. 9. The lever arm is depressed to release the gripper bar and allow free movement of the material. Plastic grommets 54 and 54*a* are used to furnish a sliding surface for the cords. Cover 56, is mounted over the face of the assembly.

In another preferred embodiment the gripper bar 28, is released by an alternatemeans. Lever arm 34*c*, as shown in FIG. 14 and lever arm 34*d*, as shown in FIG. 10 are located at opposite ends of the track 18. Note in FIG. 14 an alternate configuration is shown for the track as 18*a*. Lever arm 34*d*, has roller 58, mounted thereon, as well as spring 60, best shown in FIG. 11. In operation and when the roller as shown here is against the carriage the gripper bar 28, is held away from contact with the cutter bar 14, and the material 52, to be cut is inserted. As the carriage is moved toward the cutting area it moves out of contact with the roller 58, and spring 60, as well as spring 60*a*, pushes against the lever arms rotating the gripper bar to hold the material against the cutter bar while the material is being cut. As the carriage reaches the opposite end the carriage pushes against roller 58*a*, to rotate and thereby move the gripper bar to free the material. The roller is used as a cam when acted against by the carriage. An example of other types of a cam that may be used include but are not limited to a wedge or a ball, but the roller is preferred.

Several embodiments are shown for mounting the cutter assembly 10, to a support 12, in addition to the one shown in FIG. 13. In FIG. 12 the cutter assembly is first fastened to channel 62, by any convenient means such as bolting, or welding. The channel in combination with a threaded eyelet 64, threaded stem 66, with swivel 68, and handle 70, form a C-clamp which may be clamped to support 12. In FIG. 14 the cutter assembly is fastened to an angle iron 72, to allow mounting on a wall, not shown.

In still another embodiment best shown in FIG. 4 an arm 74, mounted to carriage 20, extending upward and having an offset finger 76, the lower surface of which contacts the upper surface of the cutter bar 14. This arm with finger travels with the carriage to prevent deflection of a long cutter bar. The arm is mounted to the carriage as shown in FIG. 5 with screws 78 and 78*a*, and spacers 80 and 80*a*. A modified cutter wheel 22*a*, has an opening in the side contacting the cutter bar to permit the arm to occupy part of the opening.

In still another preferred embodiment as shown in FIG. 8 a modified track 18*a*, is slotted to permit a modified carriage 20*a*, to slide but not to pivot. Modified cutter wheel 22*b*, is rotatably mounted with bearing 82, and retainer rings 84, to pin 86, which is slideably mounted to the carriage. The pin has a raised portion 90, and a resilient means such as a spring 92, acts between the carriage and the cutter wheel through the pin to resiliently force the edge of the cutter wheel against the face 16, of the cutter bar 14. The cutter wheel 22*b*, may have an intact width or it may be cut out with an opening as shown in FIG. 8 to accommodate a modified arm 74*a*. Either of the previously discussed methods of releasing the gripper bar 28, may be used in conjunction with this as well as the other methods shown for supporting the carriage.

Figure 1:
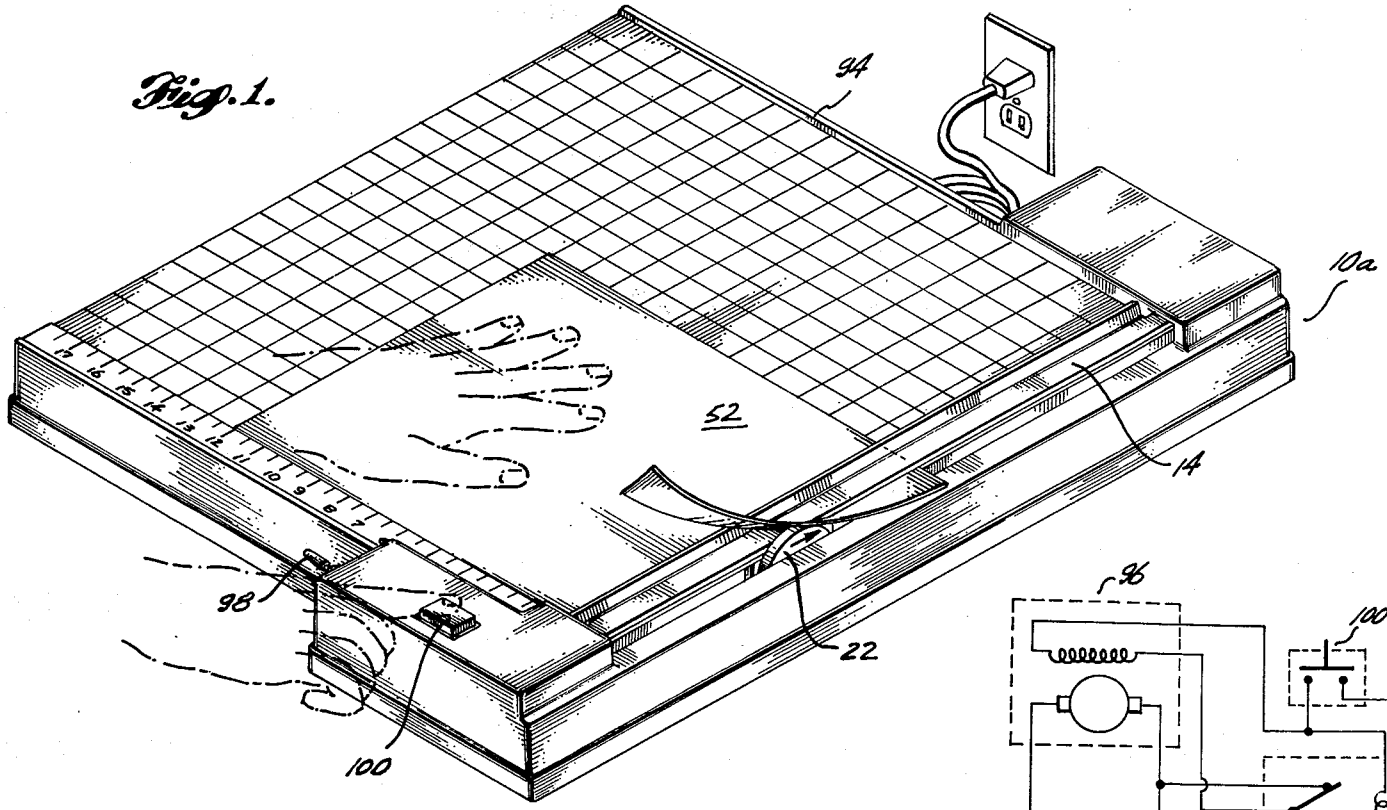
FIG. 1 is an isometric view of an electric powered cutter.
Figure 2:
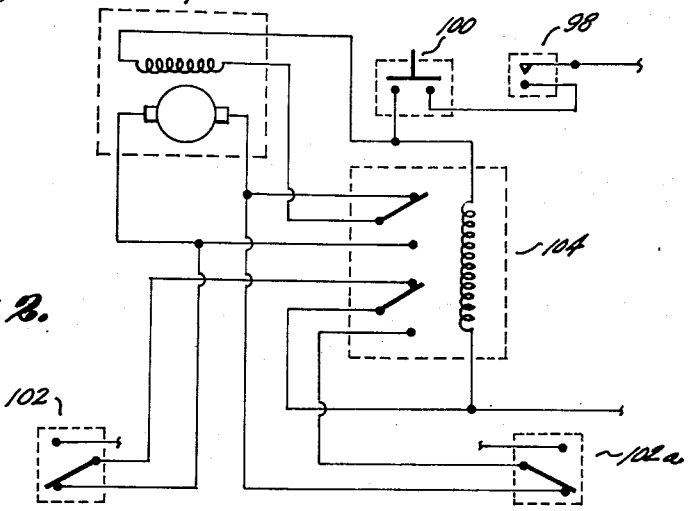
FIG. 2 is a schematic of the electric circuit used to control the powered cutter.

In another preferred embodiment, as shown in FIG. 1, a frame provides a surface for material 52, and a support for the cutter assembly 10*a* and electric motor 96. In FIG. 2 there is shown an on-off switch 98, momentary action switch 100, motor 96, limit switch 102, and 102*a*, and double pole double throw sequence stepper relay 104, which automatically reverses the motor each time the motor is stopped. In operation switch 98, is energized and momentary switch 100, held down to run the carriage 20, to one side of the cutter 10*a*. The carriage contacts roller 58, or 58*a*, which releases gripper bar 28, to allow insertion of material. Switch 100, is again energized and the carriage moves toward the cutting area and away from the roller, springs 60 and 60a, force the gripper bar with the material against the underside of the cutter bar 14, and the material is cut. If the momentary switch is still held down the carriage will go to the end of travel. The limit switch shuts down the motor and the relay reverses the direction on the motor. The carriage again is contacting a roller to pivot the gripper bar and allow free movement of the material into or out of the cutter.

In one motor driven embodiment the drive system as shown in FIG. 7 has motor shaft 106, with sprocket 108, mounted thereon. A continuous chain 110, goes around the sprocket and another similar sprocket, now shown, at the opposite end of the track. An arm 112, attaches to the modified carriage 206, and engages a tooth of the chain. Note in FIG. 7, an alternate track 18*b*. This carriage is pivoted by a spring and plunger 114, the tip of which may be nylon, teflon or similar low friction wearing material.

In another preferred motor driven embodiment, best shown in FIG. 3, the means for connecting the motor 96, to the carriage 20, has a sheave 116, connected to the shaft 106, of the motor, an idler pulley 118, sheave 120, and a flexible belt 122, encircling the two sheaves and idler pulley. The sheave 120, has a capstan 124, as its hub. A pair of pulley wheels 126 and 126*a*, and a cord 128, one end of which connects to one end of the carriage thence around pulley 126, thence encircles the capstan thence around pulley 126*a*, thence connects to the other end of the carriage. This allows an essentially direct line of pull by the cord on the carriage. In operation the sheave 120, is driven by the motor through flexible belt 122, and the cord 128, is powered from the capstan to move the carriage. In an alternate embodiment carriage 20*a*, with the means shown in FIG. 8 for maintaining the cutter wheel 22, against the face 16, of the cutter bar 14, may be used.

A soft rubber coating 130, may be placed as shown in FIG. 7 on the underside of the cutter bar 14, or a coating 130*a*, may be placed on the top of the gripper bar 28, to assist in firmly holding the material 52.

Alternate carriage 18*c*, as shown in FIG. 4 may be used.

In yet another embodiment of a cutter assembly 132 the track 134 is preferably an extrusion. Rotatable cutter wheel 136 is supported by an axial shaft member 138. The shaft member in combination with L-shaped member 140 and low friction wear member 142 make up the carriage that supports the cutter wheel. A wear member 144, which may be nylon or other low friction materials, is resilently urged by spring 146 against the carriage, or as shown here the wear member may work against a low friction insert 148. The action of the spring pivots the carriage to force the side 150 of the cutter wheel against the face 152 of cutter bar 154. In this embodiment a reinforcing angle 156 is shaped to prevent deflection and has a lip 158 which extends to pass under the cutter bar. The reinforcing angle provides support to the cutter bar throughout its length to prevent deflection. A bearing type sliding member 160 is supported by the track. A U-shaped member 162 is attached at an inside leg 164 by a bolt 166. A handle 168 is attached to the outside leg 170 of the U-shaped member and the leg has a slot or recess 172 at the end to accept the cutter wheels' axis member. The recess surrounds the axis member and exerts pressure against same to move the carriage. Downward pressure on the handle bends the U-shaped member to exert pressure against retainer ring 174 which trys to rotate the carriage to assist the spring 146 in holding the cutter wheel against the cutter bar. Other embodiments may dispense with the spring and use the handle action to urge the cutter wheel against the cutter bar. Track projection 176 holds mating finger 178 which is attached to material holder 180 for catching the cut flat stock material. A gripper bar 182 in this embodiment is held against the underside of the cutter bar by spring 184 and is pivoted to allow entrance of material by use of offset handles 186 or 186*a*. The pivot area 188 of the gripper bar is nested between a recess 190 in the track 134 and hold down bars 192 and 192*a*. A rod 194 with ears 196 extends out to the offset handles. The hold down bar has pins 198 and 198*a* which are used to index the grid sheet 200 to maintain the grid in spaced relation to the cutter assembly 132. End plates 202 and 202*a* have inwardly extending pins 203 and 203*a*. The end plates extend over table support member 204, and in this embodiment angle iron 204 is fastened to the table support member with screw 206. A protective cover 207 extends across the face of the cutter and is shaped to snap into and out of position over end plate pins 203 and 203*a*.

In yet another embodiment a support member 208 extends parallel to the face 210 of cutter bar 212. The support member has arms 214 and 214*a* extending normal to the support thence into bar 216 and 216*a* respectively. The bar is pivotally mounted to permit rotational movement of the support member 208. A cap 218 and 218*a* are mounted to the ends of pivotal shaft 220 which holds gripper bar 222. A spring 224 is mounted at each end of the shaft to hold the gripper bar in a released position to permit free movement of flat stock material. Pin 226 extends normal to shaft axis from cap 218 and cooperates with pin 228 which extends parallel to the shaft axis from bar 216. A similar arrangement with pins 226*a* and 228*a* is located at the other end of the cutter. Spring reaction urges the parallel support member to the raised position. In this embodiment the carriage 230 is supported by a cam follower type roller 232, but a sliding support may also be used.

A bell crank type member 234 is slideably and pivotally mounted to the parallel support member 208. A handle 236 is fastened to one arm of the bell crank and the other arm has recess or slot 238 to provide means of contact with carriage axis member 240. In operation a material to be cut is placed in position under the cutter bar 212. Handle 236 is pushed downward to rotate bar 216 to act through cooperating pins 226 and 228 and pins 226*a* and 228*a* to rotate the gripper bar up against the underside of the cutter bar. Movement of the depressed handle along parallel support bar moves the carriage with cutter wheel 242 to cut the flat stock material. Releasing the handle releases the flat stock material.

The cutter bar when worn may be removed, turned and replaced to present a new cutting edge. The bar may be turned over and turned end for end; so that four cutting edges are used before the bar need be resharpened. The cutter wheel may also be removed, turned and remounted to present a new cutting surface.

While the invention has been described and illustrated with reference to specific embodiments thereof it will be understood that other embodiments may be resorted to without departing from the invention. Therefore, the form of the invention set out above should be considered as illustrative and not limiting the scope of the following claims.

I claim:

1. A cutter assembly for cutting flat stock materials comprising: a cutter bar located such that material to be cut positions under the cutter bar allowing a view of the exact line to be cut; a track located below the bar; a carriage moveably mounted in the track; a freely rotatable cutter wheel mounted to the carriage with a side of the wheel in contact with the face of the cutter bar, said cutter wheel of a width to push away an operator's hand placed against the cutter bar without cutting the operator; means for urging the cutter wheel against the cutter bar; and a handle mounted to the carriage to allow moving the carriage such that the mounted cutter wheel moves along the face of the cutter bar to cut the flat stock material.

2. A cutter assembly as in claim 1 wherein the means for urging the cutter wheel against the face of the cutter bar includes means for mounting the handle to move the cutter wheel against the face of the cutter bar when the handle is pressed downward.

3. A cutter assembly as in claim 1 further comprising a continuous support along the length of the cutter bar.

4. A cutter assembly for flat stock material as in claim 1 wherein the means for urging the cutter wheel against the face of the cutter bar comprises a resilient means.

5. A cutter assembly for flat stock material as in claim 4 wherein the handle mounting to the carriage includes means for imparting additional pressure of the cutter wheel against the face of the cutter bar.

6. A cutter assembly for flat stock material as in claim 5 further comprising a pivotable gripper bar, means for urging the gripper bar against the underside of the cutter bar to hold the flat stock material in place during the cutting cycle, and means for releasing the grippr bar to allow freedom of movement of the material at other times.

7. A cutter assembly as in claim 4 wherein the means for urging the gripper bar against the underside of the cutter bar comprises resilient means, and the means for releasing the gripper bar comprises a lever arm fastened to the end of the gripper bar and extending at essentially at right angle to a pivot line of the gripper bar such that movement of the lever arm acts against the resilient means to rotate the gripper bar away from the underside of the cutter bar.

8. A cutter assembly as in claim 7 further comprising a support along the length of the cutter bar.

9. A cutter assembly as in claim 8 further comprising a frame into which the cutter assembly is integrated, said frame includes a gridded surface in spaced relation to the cutter assembly.

10. A cutter assembly as in claim 8 further comprising means for fastening the cutter assembly to a support.

11. A cutter assembly as in claim 10 further comprising means for fastening a grid to the support in spaced relation to the assembly.

12. A cutter assembly as in claim 10 further comprising means for catching cut material.

13. A cutter assembly for cutting flat stock material comprising: a cutter bar located such that material to be cut positions under the cutter bar; a track located under the cutter bar and extending parallel with the line of cut; a carriage moveably and pivotally mounted to the track such that the carriage when moving remains parallel with the line of cut and when pivoting moves normal to the line of cut; a cutter wheel rotatably mounted to the carriage; a spring slidably mounted to move with the carriage, located to pivot the carriage forcing a side of the cutter wheel against the face of the cutter bar; and a means for mounting a handle to the carriage to allow moving the carriage such that the cutter wheel moves along the face of the cutter bar to cut the flat stock material.

14. A cutter assembly as in claim 13 wherein the means for mounting the handle comprises: a pivotally mounted member extending parallel to the line of cut; a bell crank type arm pivotally mounted to the pivotally mounted member, said bell crank having the handle fastened to one arm and means for imparting movement through an axis member of the cutter wheel with the other arm, a gripper bar located under the cutter bar to hold flat stock material against the cutter bar, means for resiliently releasing the gripper bar, and means for counteracting the resilient means to grip the flat stock material during the cutting cycle.

15. A cutter assembly as in claim 13 wherein the means for mounting the handle to the carriage comprises: a U-shaped member having an inner leg slideably mounted to the track and an outer leg fastened to the handle, said outer leg having a recess on the end to extend around and impart movement to an axis member of the cutter wheel when the handle is moved.

16. A cutter assembly as in claim 15 further comprising: a gripper bar, means for urging the gripper bar against the underside of the cutter bar to hold material to be cut during the cutting cycle, and means for releasing the gripper bar to permit placing the flat stock material in position for cutting.

17. A cutter assembly for cutting flat stock material comprising: a cutter bar located such that material to be cut positions under the cutter bar; a track located under the cutter bar and extending parallel with the line of cut; a carriage moveably and pivotally mounted to the track such that the carriage when moving remains parallel with the line of cut and when pivoting moves normal to the line of cut; a cutter wheel rotatably mounted to the carriage; a spring slideably mounted to move with the carriage, located to pivot the carriage forcing a side of the cutter wheel against the face of the cutter bar; a U-shaped member having an inner leg slideably mounted to the track and an outer leg having a recess on the end to extend around and impart movement to an axis member of the cutter wheel; a handle mounted to the outer leg; a gripper bar; means for resiliently holding the gripper bar against the bottom of the cutter bar; and means for releasing the gripper bar.

18. A cutter assembly for cutting flat stock material as in claim 17 further comprising: means for fastening the cutter assembly to a support, and means for fastening a grid to the support in spaced relation to the cutter assembly.

19. A cutter assembly as in claim 17 further comprising means for integrating the cutter assembly into a frame having a grid in spaced relation to the cutter assembly.

20. A cutter assmbly as in claim 17 further comprising means for supporting the cutter bar along its length.

* * * * *